US012405077B2

(12) United States Patent
Malichen-Snyder

(10) Patent No.: US 12,405,077 B2
(45) Date of Patent: Sep. 2, 2025

(54) REMOTELY ACTIVATED FIREARM ACCESSORY

(71) Applicant: Thomas Joseph Malichen-Snyder, Kingston (CA)

(72) Inventor: Thomas Joseph Malichen-Snyder, Kingston (CA)

( * ) Notice: Subject to any disclaimer, the term of this patent is extended or adjusted under 35 U.S.C. 154(b) by 36 days.

(21) Appl. No.: 18/471,039

(22) Filed: Sep. 20, 2023

(65) Prior Publication Data

US 2025/0027735 A1 Jan. 23, 2025

Related U.S. Application Data

(63) Continuation-in-part of application No. 17/367,819, filed on Jul. 6, 2021, now Pat. No. 11,774,199.

(51) Int. Cl.
*F41A 17/06* (2006.01)

(52) U.S. Cl.
CPC ..... *F41A 17/063* (2013.01)

(58) Field of Classification Search
CPC ..... F41A 17/06; F41A 17/56
USPC ..... 42/70.11
See application file for complete search history.

(56) References Cited

U.S. PATENT DOCUMENTS

2014/0230300 A1* 8/2014 Haq ..... F41A 17/54 42/70.06
2014/0290110 A1* 10/2014 Stewart ..... F41A 17/46 42/70.11
2014/0360073 A1* 12/2014 Stewart ..... F41A 17/08 42/70.11
2023/0010591 A1* 1/2023 Malichen-Snyder ... F41A 17/54

* cited by examiner

*Primary Examiner* — Samir Abdosh

(57) ABSTRACT

The invention relates to an electronic device that is used to block the accessibility of a firearms Trigger. Wherein an electronic device is mounted on a rail or rail accessory and is locked in place using a lock and frame allowing the device to fit an array of firearms. The lock and frame are in place to stop easy removal unless the possessor has the key to remove them. The device its self uses a battery to operate and picks up a transmission broadcasted from a Bluetooth within its programmed range by the use of a Bluetooth proximity detector. Once the transmission has been picked up it activates its locking mechanism in the form of a solenoid causing its pin to shift and allows a slide placed in front of the trigger acting as a second trigger to move back and forth allowing the movement of the firearms trigger. The slide is moved back into its original position by the use of a spring. When the Bluetooth is out of the device's proximity detectors programmed range, the solenoid returns to its locked state stopping access to the trigger. Making the trigger locking device a beneficial reusable safety device.

14 Claims, 10 Drawing Sheets

REMOTELY ACTIVATED FIREARM ACCESSORY

BACKGROUND OF THE INVENTION

Field of the Invention

The invention generally relates too a firearm safety device in the form of a self-locking slide acting as a second trigger, mounted in front, against the sides, and behind the firearms trigger by the use of a rail or rail accessory allowing compatibility to a wide variety of firearms. It is activated by a Bluetooth proximity detector picking up a broadcast transmission signal from a worn Bluetooth device, thus signaling a magnetic solenoid pin to shift allowing the user to pull the slide that was acting as a second trigger denying access to the firearms trigger, against the firearms trigger discharging their firearm. A spring pushes the slide acting as the second trigger back into position when the trigger is released or not under pressure. The devices solenoid relocks the use of the slide acting as a second trigger when the Bluetooth is out of the Bluetooth proximity detectors predetermined range.

Background

Some attempted solutions have tried finger print detection, barrel locks that discharge with a turning combination and RFID embedded hand grips that control the firing pins, but this has not sufficiently addressed the needs of the firearms safety industry owing to the needed modifications to the gun, usability issues such as only being compatible with a few models, or the lock was designed to discharge or fall off providing no lasting safety from someone else using the owners weapon against them.

SUMMARY

This invention relates to a method and means of a trigger locking device for firearm safety purposes. This trigger locking device uses electronic and mechanical parts. The device works by the use of a Bluetooth proximity detector, solenoid, switch and spring-loaded slide that acts as an open trigger cover obstructing the trigger from the front, sides and behind allowing your trigger to be accessible with the ability to put your finger around it but inoperable. The device is powered by rechargeable lithium-ion batteries. The Bluetooth proximity detector operates the solenoid and unlocks it indefinitely until a Bluetooth broadcast transmission is broken at which point the solenoid would relock the spring-loaded slide again. The proximity detector connects with a Bluetooth enabled wrist worn device worn by the user, and will connect within a predetermined distance of foot or less of the safety device containing the proximity detector. The device as a whole has a switch to turn on and off. Once on the proximity detector will indefinitely search for its pre-set Bluetooth connection. The proximity detector will only be programmed to operate when the Bluetooth device being used specifically for the safety device is in range, stopping the possibility of other Bluetooth devices from interfering or unlocking the slide controlling the trigger on the firearm. The device is attached to a firearm though the use of a gun rail, or gun rail attachment, it is then locked with a key and frame covering itself and the firearm, thus making removal without its key extremely difficult.

The purpose of this Invention is safety. One main advantage of the invention is to protect concealment or open carry users, particularly in civilian use, from being hurt by their own firearm. For example, someone where to attack a carrier overpower them and take control of their firearm, or the carrier drew their weapon but decided not to shoot and the attacker gained control of the weapon, the carrier could decide to run or fight while the attacker tried to operate their weapon unsuccessfully, thus potentially saving ethers lives. Another advantage is around young children the device would be inoperable without serious intent and knowledge of operation, time, effort, and resources not typical of young children. These are just some examples of its purpose and benefits however one large advantage that should be empathized is animosity, this device and its users compatible wrist worn Bluetooth device are chosen by the user alone and selected through their devices app, the device once set will in no way will store information about the user or their location or activities related to their firearm in any term or personal movements and can be disconnected at their choosing at any time, it is merely capable of stopping the ability to pull a trigger and can be removed from the rail of the firearm or rail accessory on the firearm at any time using the key provided if they cant gain electronic access. This invention is meant to operate on all sorts of firearms giving it a wide array of compatibility.

DETAILED DESCRIPTION OF DRAWINGS

Figure 1:
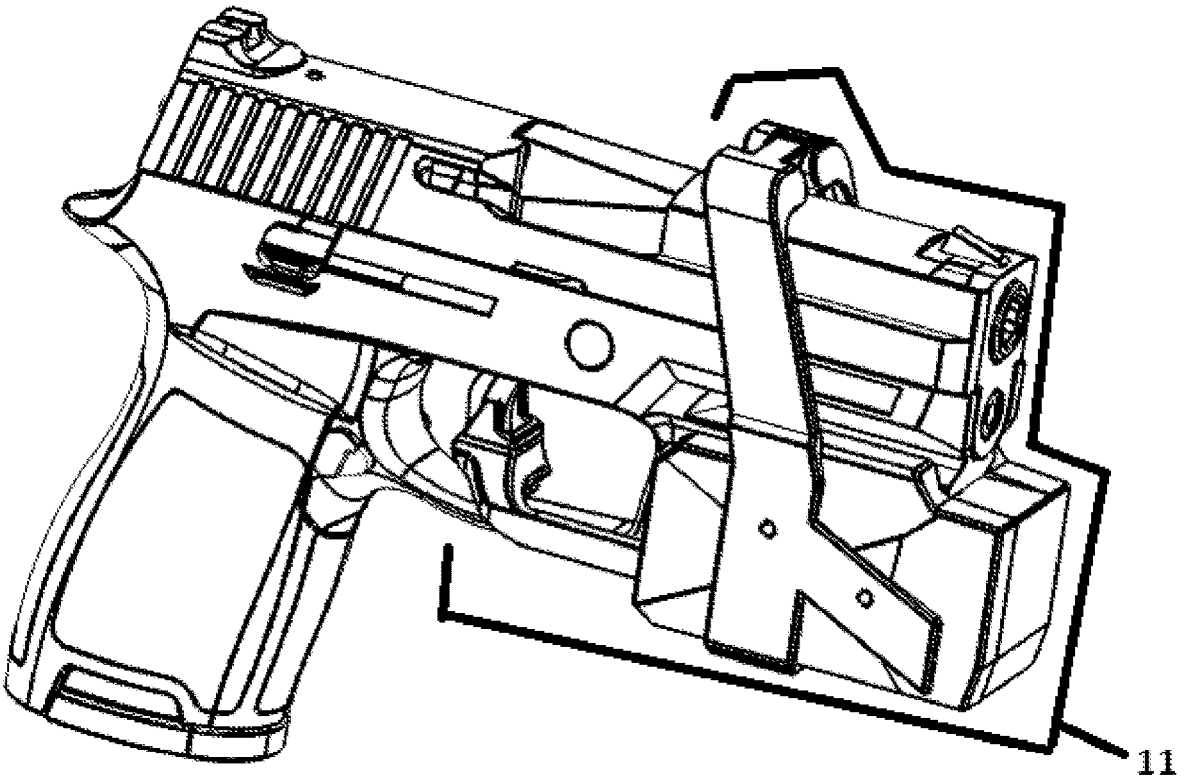
FIG. 1 depicts the device attached to a firearm rail.
Figure 2:
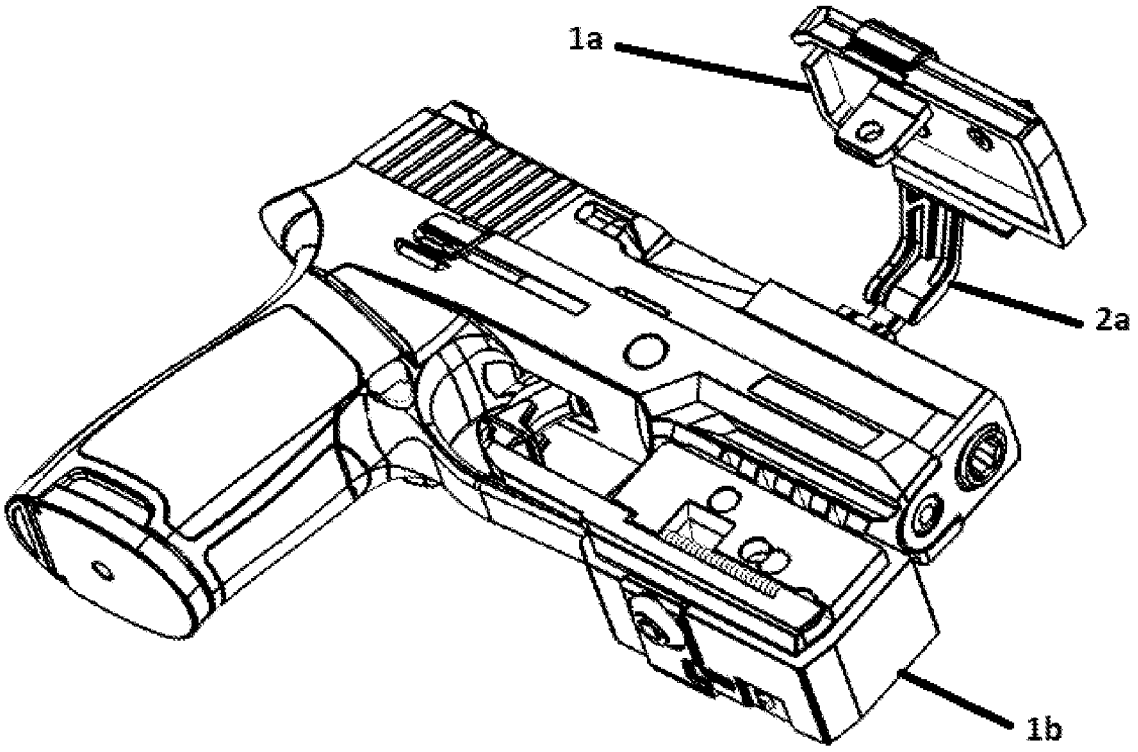
FIG. 2 depicts a perspective view of the device not fully closed and locked around the firearm.
Figure 3:
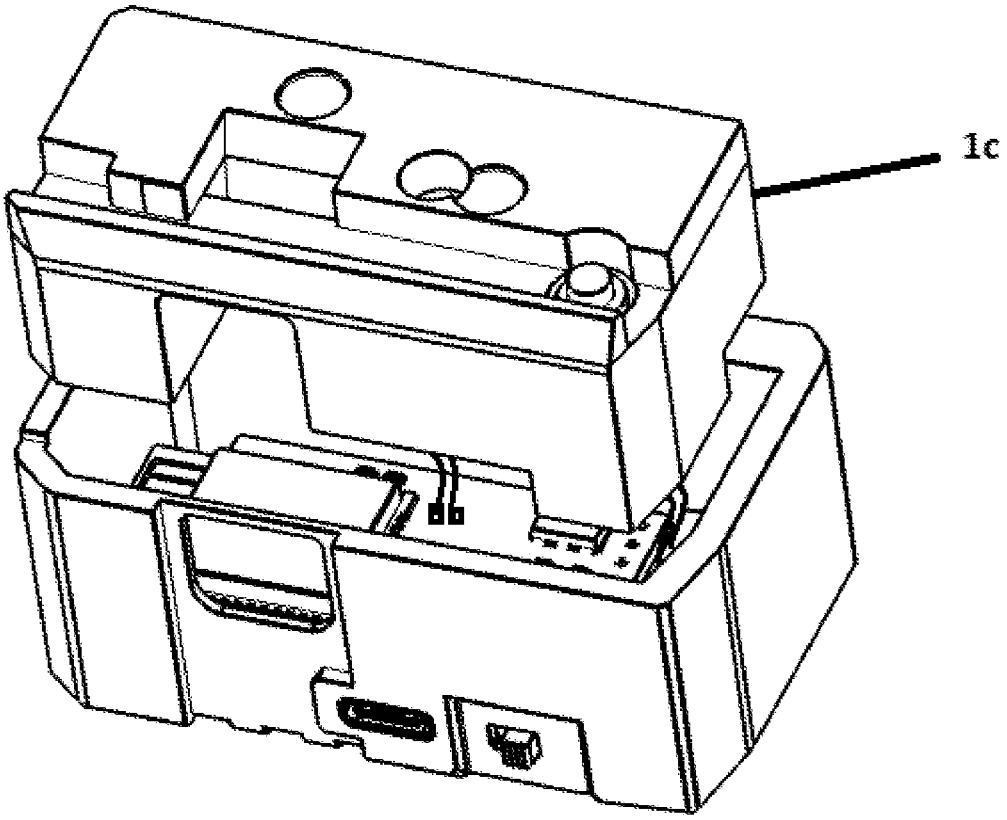
FIG. 3 depicts the internal casing being placed into the external casing.
Figure 4:
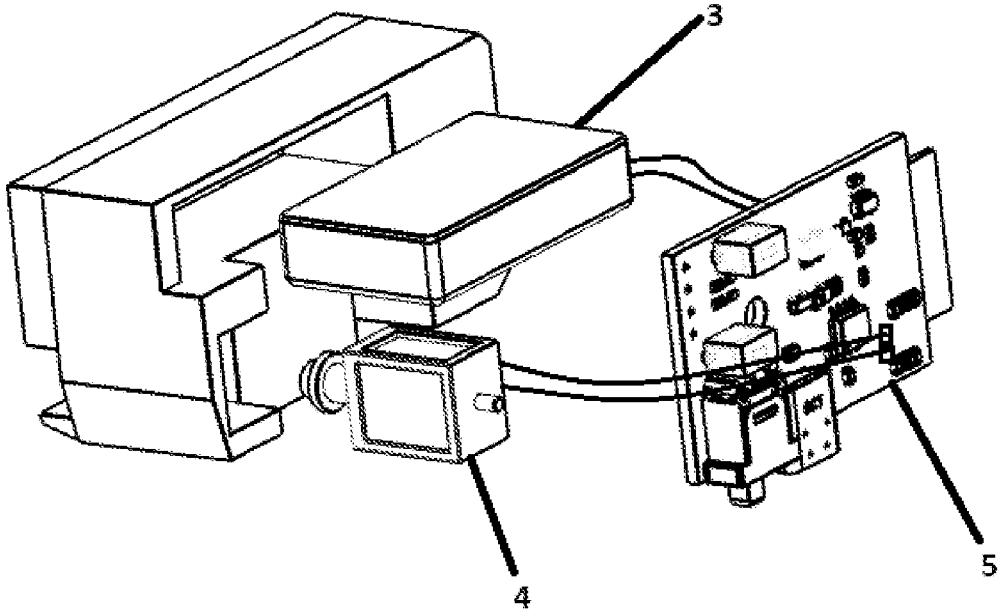
FIG. 4 depicts main electronic components of the device being placed into internal casing.
Figure 5:
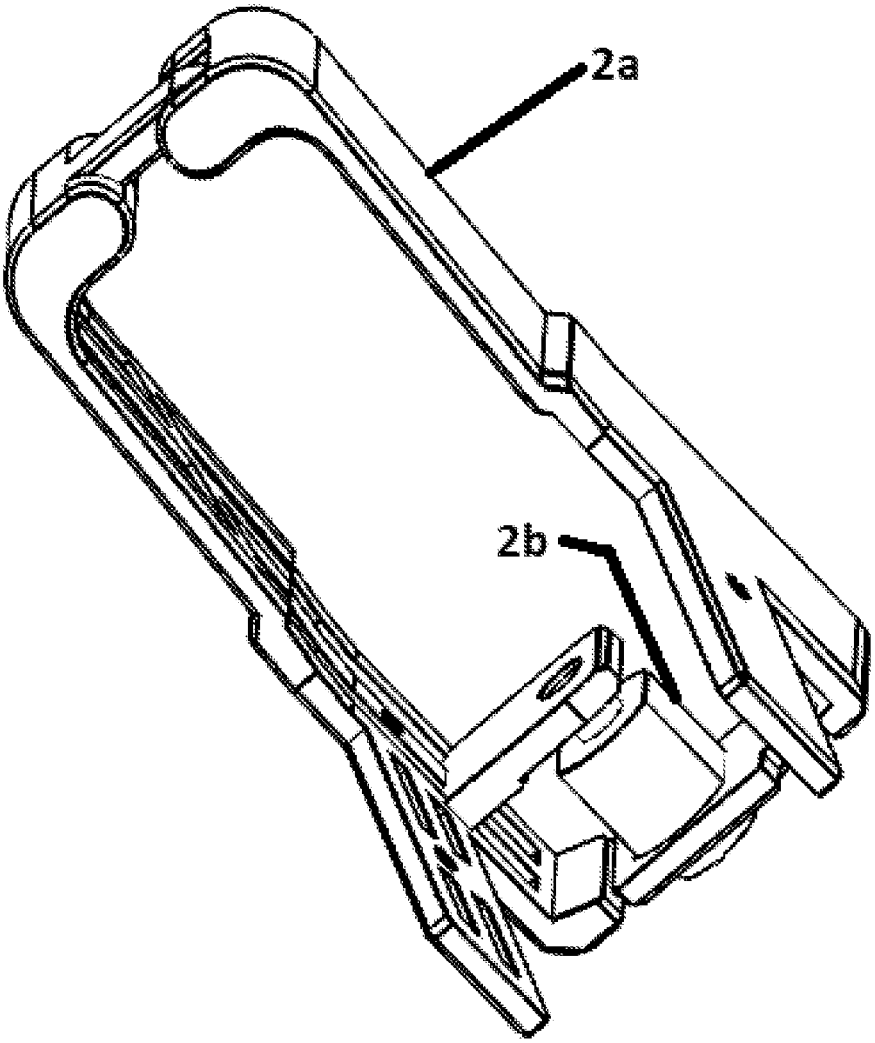
FIG. 5 depicts the frame and non electronic lock of the device.
Figure 6:
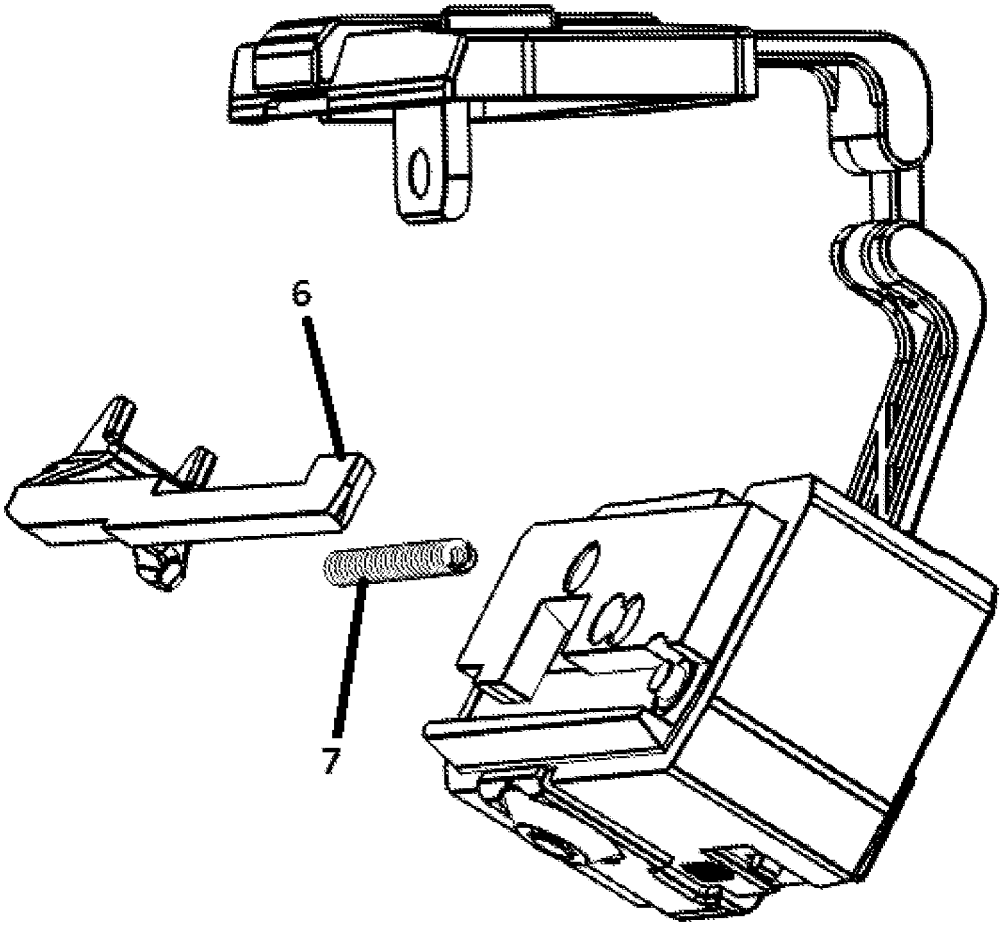
FIG. 6 depicts the device with the spring and slide exposed.
Figure 7:
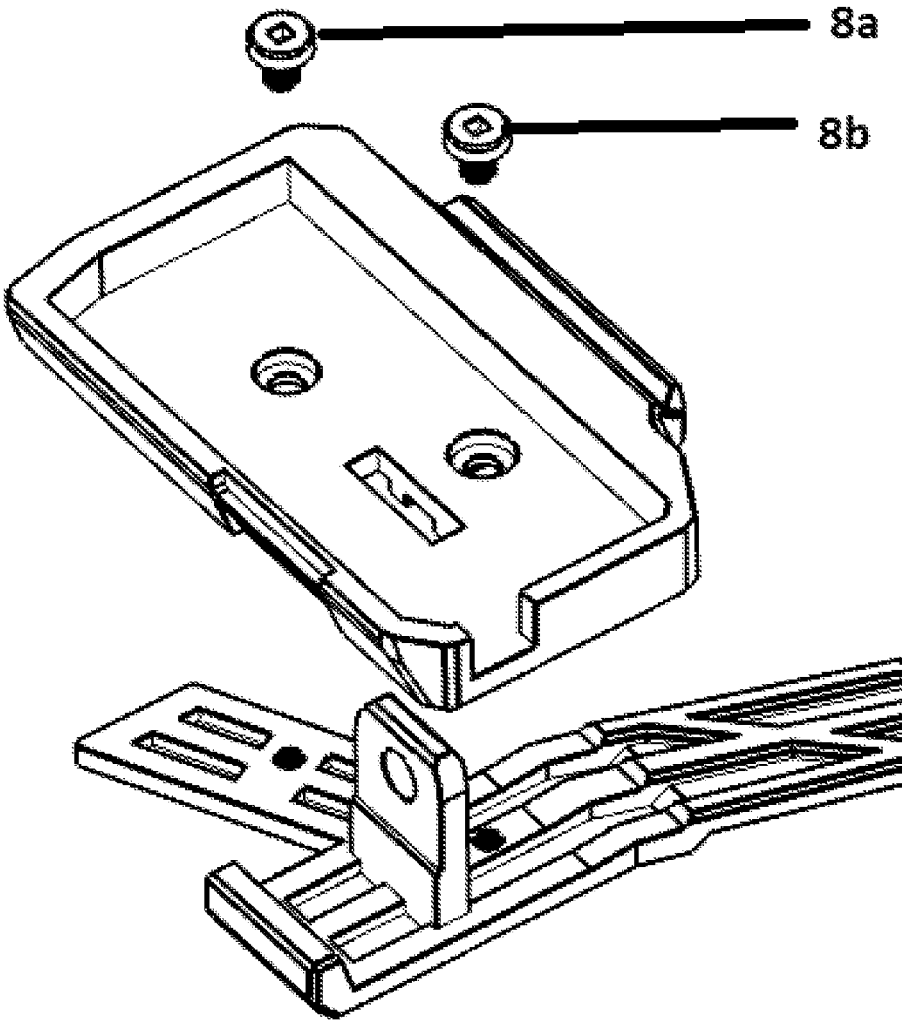
FIG. 7 depicts a piece of the devices casing and where it is fastened on its inner side to the frame using screws.
Figure 8:
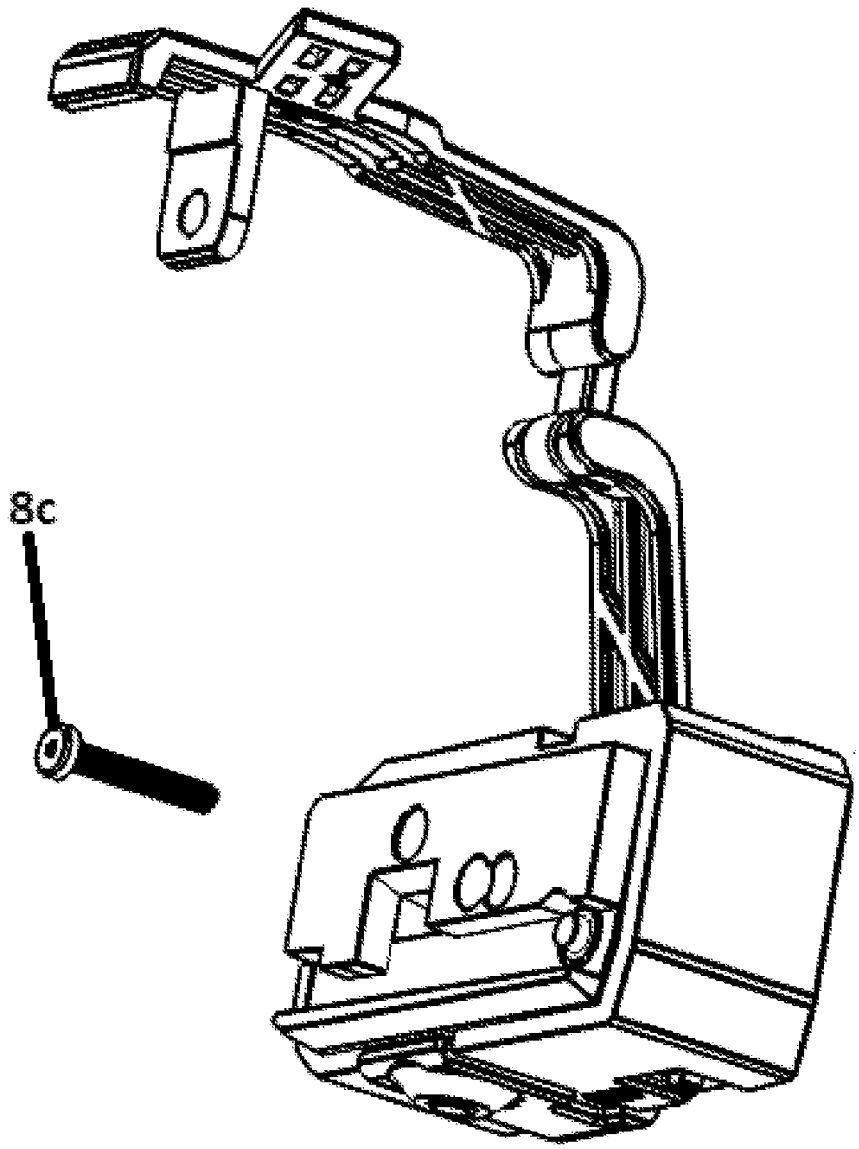
FIG. 8 depicts how the internal casing is fastened into the device and subsequently frame internally using screws.
Figure 9:
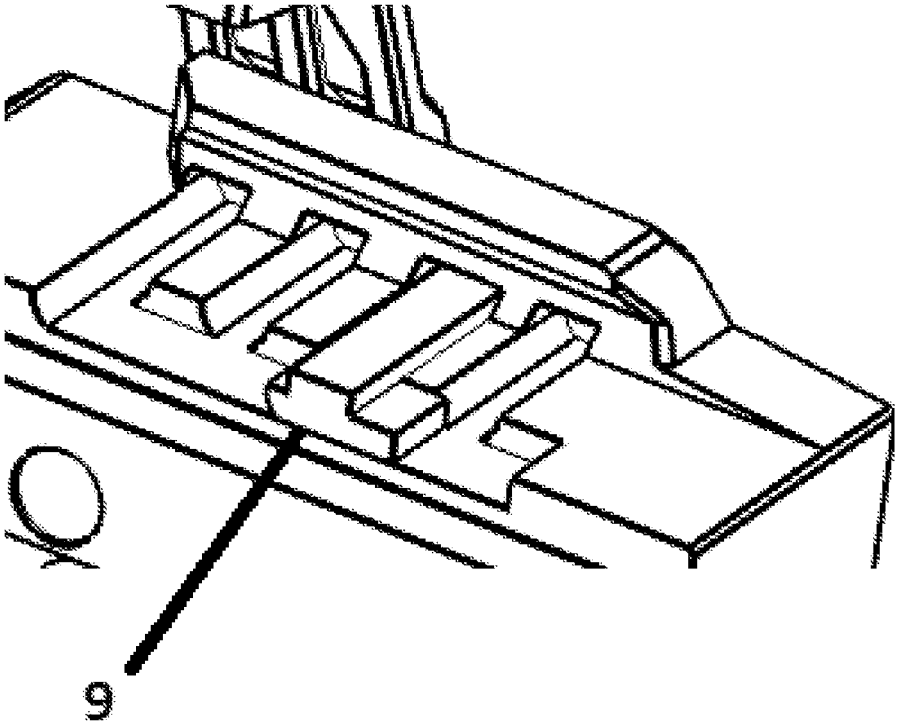
FIG. 9 depicts one of the rail slots on the device holding a pin.

The device 11 (FIG. 1) comprises a casing consisting of three pieces 1*a*, 1*b*, 1*c* (FIGS. 2 and 3). A solenoid 4, a PCB board containing a proximity detector 5, and a battery 3 (FIG. 4), are placed inside the internal casing 1*c* (FIG. 3) and is then placed into an external piece of casing acting as the container 1*b* (FIG. 2). A frame 2*a* and a lock welded to the frame 2*b* (FIGS. 2 and 5) is then inserted inside the internal casing 1*c* and around the external casing acting as the container 1*b*. a screw 8*c* (FIG. 8) is then screwed threw the internal casing 1*c*, through a mounting hole in the PCB containing the proximity detector 5 and into the frame 2*a* securing the pieces together. Two screws 8*a* and 8*b* (FIG. 7) are then screwed to the inward face of the casing 1*a* to the frame 2*a* securing the final piece of casing acting as a cover to the fame 2*a*. A slide 6 and a spring 7 (FIG. 6) are then placed in the space provided in the internal casing 1*c*. A pin 9 (FIG. 9) is then placed in one of the spaces provided within the external casing of 1*b* to secure the device to the firearm.

Figure 10:
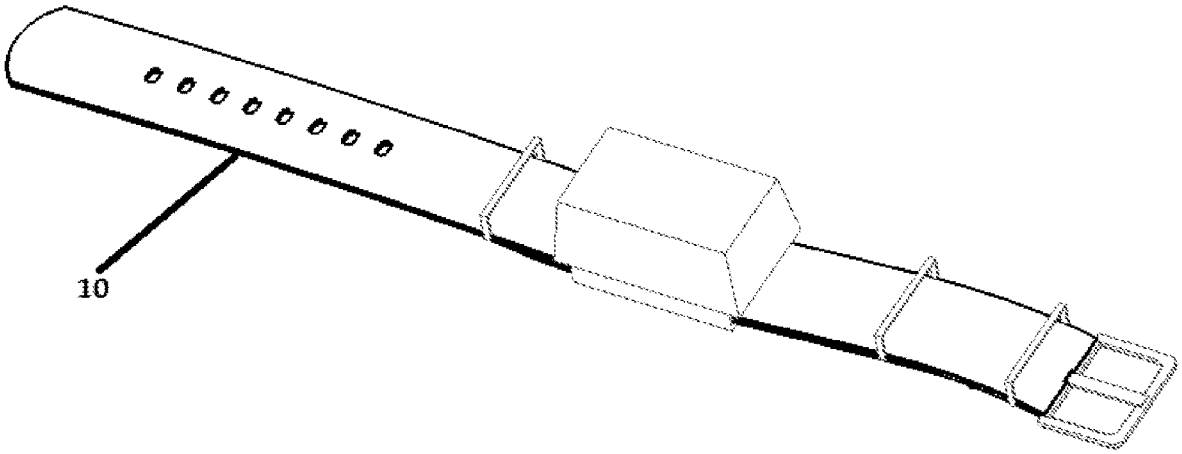
FIG. 10. Depicts a rechargeable Bluetooth bracelet.

To properly operate said device the Bluetooth wrist worn device 10 (FIG. 10) is placed on the hand you draw your gun with.

I claim:

1. A firearm trigger locking accessory comprising; a slide which protrudes from a housing, said slide configured to cover the front, left, right, and back of a firearm's trigger while allowing access within the trigger guard, said slide being interchangeable; a Bluetooth Low Energy (BLE) proximity detector; a switch controlling or partly controlling a power supply of the accessory; a solenoid to lock and unlock said slide; a spring-driven mechanism to return said slide to a lockable position; a frame that holds the housing closed and contains a mechanical lock; wherein, when mounted, said frame is extended over a firearm and around the upper barrel; and said firearm trigger locking accessory is configured to mount to a firearm and/or a firearm rail accessory.

2. The firearm trigger locking accessory of claim 1, wherein the slide is removable when the frame is unlocked and the housing is opened.

3. The firearm trigger locking accessory of claim 1, wherein the slide is interchangeable with other slide components specific to different firearm models.

4. The firearm trigger locking accessory of claim 1, wherein the mechanical lock comprises a keyed locking mechanism.

5. The firearm trigger locking accessory of claim 1, wherein the spring-driven mechanism comprises a compression spring configured to compress when the slide is moved and return the slide to its original position upon release.

6. The firearm trigger locking accessory of claim 1, wherein the Bluetooth Low Energy (BLE) proximity detector is configured to pair only with authorized devices.

7. The firearm trigger locking accessory of claim 1, wherein the switch is physically accessible for manual power override.

8. The firearm trigger locking accessory of claim 1, wherein the solenoid is activated based on proximity detection by the BLE proximity detector.

9. The firearm trigger locking accessory of claim 1, wherein the battery is housed within the housing.

10. The firearm trigger locking accessory of claim 1, wherein the housing is formed from a polymer material.

11. The firearm trigger locking accessory of claim 1, wherein the frame acts as a tamper-resistant shield for the housing and internal components.

12. The firearm trigger locking accessory of claim 1, wherein the slide engages with the solenoid through a catch located on the side of the slide.

13. The firearm trigger locking accessory of claim 1, wherein the BLE proximity detector is embedded within the housing.

14. The firearm trigger locking accessory of claim 1, wherein the Bluetooth Low Energy proximity detector, solenoid, slide, and spring-driven mechanism operate together to partly automate the lock and unlock procedure.

* * * * *